United States Patent [19]

Eskeli

[11] 3,972,203

[45] Aug. 3, 1976

[54] ROTARY HEAT EXCHANGER

[76] Inventor: Michael Eskeli, 7994-41 Locke Lee, Houston, Tex. 77063

[22] Filed: Aug. 31, 1973

[21] Appl. No.: 393,571

Related U.S. Application Data

[63] Continuation-in-part of Ser. No. 216,938, Jan. 11, 1972, abandoned.

[52] U.S. Cl. ..... 62/402; 62/86; 62/87; 62/499; 165/86; 165/88; 415/1

[51] Int. Cl.[2] ..... F25B 3/00

[58] Field of Search ..... 165/86, 88; 62/86, 87, 62/401, 402, 499; 415/1

[56] References Cited

UNITED STATES PATENTS

| | | | |
|---|---|---|---|
| 2,451,873 | 10/1948 | Roebuck | 165/88 |
| 2,522,781 | 9/1950 | Exner | 62/499 |
| 2,529,765 | 11/1950 | Exner | 62/499 |

FOREIGN PATENTS OR APPLICATIONS

| | | | |
|---|---|---|---|
| 633,985 | 6/1937 | Germany | 165/86 |

*Primary Examiner*—Albert W. Davis, Jr.
*Assistant Examiner*—Sheldon Richter
*Attorney, Agent, or Firm*—Jennings B. Thompson

[57] ABSTRACT

A method and apparatus for transferring heat by employing a rotating centrifuge to compress a gaseous first fluid with accompanying temperature increase and then transferring heat from said first fluid in its compressed state to a second fluid being circulated within said centrifuge in heat exchange relationship with said first fluid. After transferring said heat from said first fluid, said first fluid is allowed to expand within said centrifuge with accompanying temperature reduction. Said first fluid may then be passed out from said centrifuge, or said first fluid may be receiving heat within said centrifuge from a third fluid, being circulated in heat exchange relationship with said first fluid, after which said first fluid is again compressed within said centrifuge. Various gases may be employed as said first fluid, such as air, or halogenated hydrocarbons. Said second fluid is usually a liquid, such as water. The third fluid may also be water.

3 Claims, 5 Drawing Figures

ROTARY HEAT EXCHANGER

CROSS REFERENCES TO RELATED APPLICATIONS

This application is a continuation-in-part application of two previous applications: "Heating and Cooling Wheel", filed Jan. 11, 1972, Ser. No. 216,938 now abandoned; and "Heat Exchanger with Three Fluids", filed 5/17/73, Ser. No. 361,281 now abandoned.

Also, certain principles related to this patent application were used in "Heating and Cooling Wheel with Dual Rotor", filed 1/20/72, Ser. No. 219,212 now U.S. Pat. No. 3,791,167.

BACKGROUND OF THE INVENTION

This invention relates to devices for transferring heat from a fluid at a lower temperature to another fluid at a higher temperature by employing a compressible fluid which is compressed within a continuous flow centrifuge to an elevated pressure with accompanying temperature increase, and this higher temperature is then used to effect heat transfer to a second fluid which is at a higher temperature than said lower temperature fluid, and providing means within said centrifuge to propel said gaseous compressible fluid through said centrifuge.

There have been several devices that have provided means of transferring heat from a lower temperature fluid to a higher temperature fluid. These devices have been relatively inefficient due to the device requiring an external compressor to provide needed pressure differential to transport said gaseous compressible fluid through said centrifuge rotor.

DESCRIPTION OF PREFERRED EMBODIMENTS

It is an object of this invention to provide a method and apparatus for transferring heat from a compressible and gaseous first fluid initially at a lower temperature to a second fluid at a higher temperature by compressing said first fluid within a centrifuge with accompanying temperature increase so that said first fluid is at a higher temperature when compressed than said second fluid thus providing needed temperature differential; said first fluid then being allowed to expand within said centrifuge with accompanying temperature decrease; said first fluid being passed via nozzles arranged to discharge backward near the periphery of said centrifuge rotor with this passing through said nozzles reducing the tangential velocity of said first fluid and providing for needed pressure differential to transport said first through said contrifuge rotor. Further, it is an object of this invention to provide an apparatus and method wherein said first fluid may be sealed within said centrifuge rotor circulating within said rotor and releasing heat to said second fluid in its compressed state, and receiving heat from a third heating fluid in its low pressure state, with said nozzles providing needed pressure differential, in addition to pressure differential produced by placement of heating and cooling heat exchangers, to circulate said first fluid within said rotor cavity.

It is also an object of this invention to provide an apparatus to vaporize liquids and generate steam, with said second fluid being the fluid being vaporized.

Figure 1:
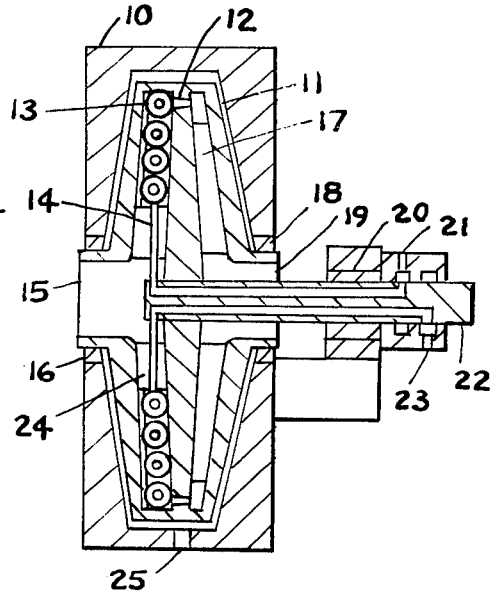
FIG. 1 is a cross section of one form of the heat exchanger.

Referring to FIG. 1, therein is shown a cross section of one form of the heat exchanger. In this unit, the first fluid enters said heat exchanger from an outside source at a predetermined temperature, and is then passed from the heat exchanger to said outside source normally at a lower temperature. Said first fluid enters rotor 11 via entry opening 15, and is passed within said rotor outwardly towards rotor periphery with vanes 24 assuring that said first fluid will rotate with said rotor. Said first fluid compressed by centrifugal action on said fluid by said rotor with accompanying temperature increase, and heat is then transferred to said second fluid being circulated within heat exchanger 13, with said second fluid being supplied to said heat exchanger 13 via distribution conduits 14 from second fluid entry 21, with said second fluid being then returned to exit 23. Said first fluid is then passed via nozzles 12 from the compression side of said rotor to expansion side of said rotor 11, with said nozzles arranged to discharge said first fluid backward, so that the total absolute tangential velocity of said first fluid is reduced to a predetermined value. Said first fluid is then passed to said rotor exit 19, near the center of rotation, with vanes 17 assuring that the said fluid will rotate with said rotor, 10 is casing, 16 and 18 are rotor bearings and seals, 20 is shaft bearing, 22 is rotor shaft attached to said rotor 11, and 25 is an opening to space between rotor and casing which may be used to evacuate said space to eliminate friction losses on said rotor external surfaces.

Figure 2:
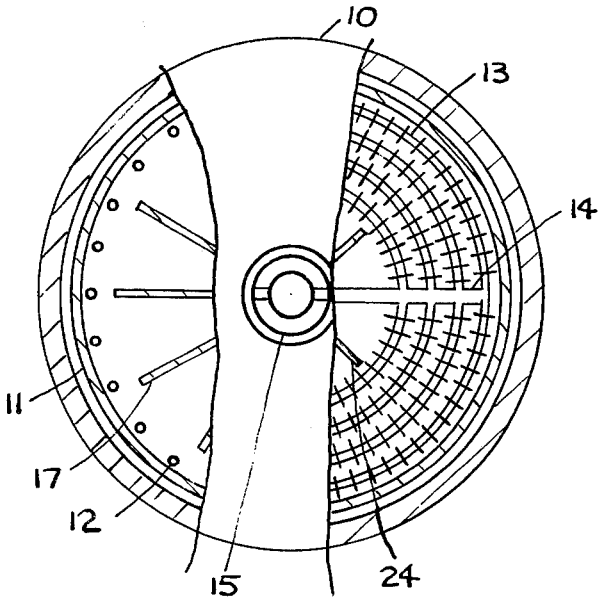
FIG. 2 is an end view of the unit shown in FIG. 1, with sections removed to illustrate interior details.

In FIG. 2, an end view of the unit shown in FIG. 1, is illustrated, with sections removed to show interior details. 10 is casing, 11 is rotor, 12 are first fluid nozzles near rotor periphery, 15 is first fluid entry, 13 is heat exchanger, 14 is fluid conduit, 17 and 24 are vanes within rotor cavities.

Figure 3:
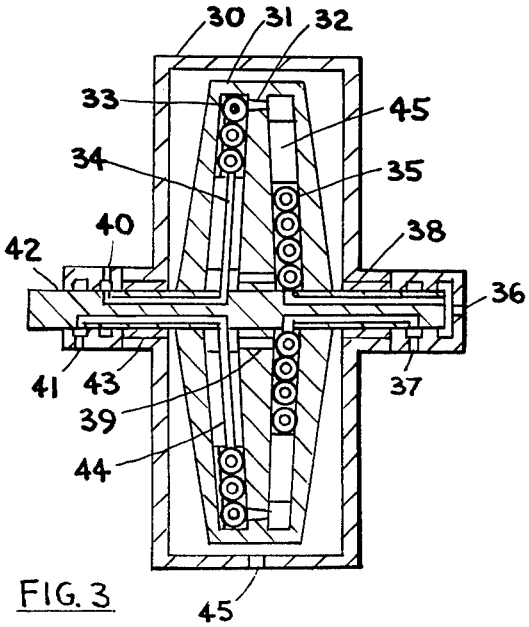
FIG. 3 is a cross section of another form of the heat exchanger.

In FIG. 3, a cross section of another form of the heat exchanger is shown. In this unit, the said first fluid is being held within said rotor with heat supplied to said first fluid by a third fluid being circulated within said rotor in a second heat exchanger. Said first fluid is compressed within said rotating rotor 31 with accompanying temperature increase with vanes 44 assuring that said first fluid will rotate with said rotor 31. Heat is transferred from the hot first fluid to a colder second fluid being circulated within heat exchanger 33, with said second fluid being circulated through conduits 34 and through entry and exit 40 and 41. Said first fluid is then passed through nozzles 32 with said nozzles arranged to discharge said first fluid in a backward direction thus reducing the absolute tangential velocity of said first fluid. Said first fluid is then allowed to expand on the expansion side of the rotor with accompanying temperature decrease, and then said first fluid will receive heat from a third fluid being circulated within said rotor in heat exchanger 35. Said third fluid is circulated through entry and exit 36 and 37. Vanes 45 assure that said first fluid will rotate with said rotor 31. After heat addition, said first fluid is passed to the compression side of said rotor via openings 39. 30 is casing, 43 and 38 are rotor shaft seals and bearings, 42 is rotor shaft attached to said rotor 31, and 45 is an opening to space between rotor 31 and casing 30 which may be used to evacuate said space to eliminate fluid friction on said rotor 31 external surfaces.

Figure 4:
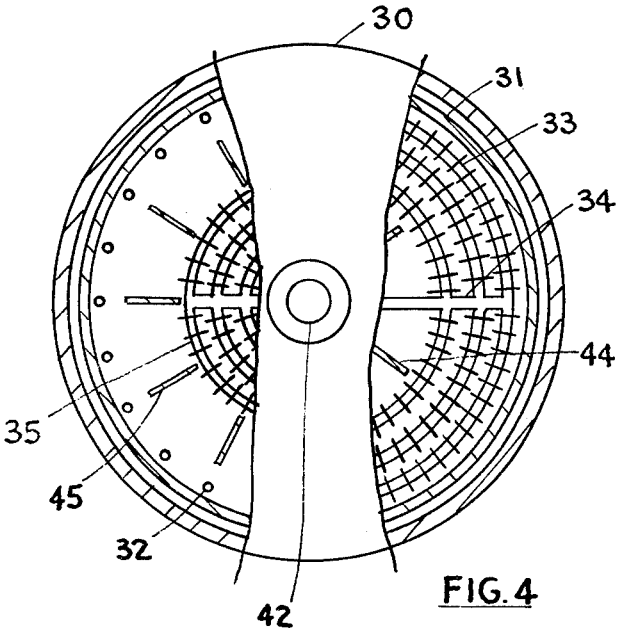
FIG. 4 is an end view of the unit shown in FIG. 3 with sections removed to illustrate interior details.

In FIG. 4, an end view of the unit shown in FIG. 3, is illustrated, with sections removed to show interior details, 30 is casing, 31 is rotor, 32 are first fluid nozzles, 44 and 45 are vanes within rotor 31 cavities, 33 is second fluid heat exchanger, and 34 is second fluid distribution conduit, 35 is third fluid heat exchanger and 42 is rotor shaft.

Figure 5:
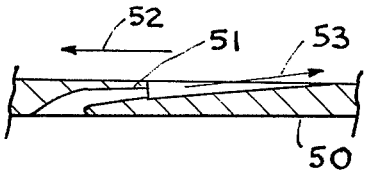
FIG. 5 is a sectional view through the central partition of the rotor taken along line 5—5 of FIG. 1.

In FIG. 5, a detail of the first fluid nozzles is illustrated. These nozzles are located as shown in the other figures near the rotor periphery in the rotor dividing wall; this wall being 50. 52 indicates direction of rotation of said rotor, 12 is said nozzle and 53 indicates the direction of the first fluid leaving said nozzle.

In operation, power is supplied at least initially to the rotor shaft to cause said shaft to rotate at a relatively high speed. The said first fluid is compressed by centrifugal action by said rotor on said fluid with accompanying temperature increase; heat is then transferred from the hot first fluid to the said second fluid being circulated in heat exchange relationship with said first fluid within said rotor. The said first fluid is then pssed through nozzles mounted in a dividing wall, in backward direction thus reducing the absolute tangential velocity of said first fluid for the purpose of providing a pressure differential to transport said first fluid through said rotor cavity. After said passage through said nozzles, said first fluid is allowed to expand within said rotor, with accompanying temperature decrease, and the first fluid may then be allowed to leave the rotor through an opening near the rotor center, or said first fluid may be heated in a third fluid heat exchanger within said rotor, and be passed through openings in rotor dividing wall near the center of rotation to be again compressed thus completing the cycle for said first fluid.

The function of said nozzles for said first fluid is to reduce the absolute tangential velocity of said first fluid by discharging said first fluid backward so that the fluid discharge velocity relative to rotor, is subtracted from the rotor speed. Since the pressure of said first fluid is higher at the point where said nozzles are located than at rotor center, and said pressure is due to the tangential velocity of said fluid, the reduction of said tangential velocity will also be accompanied by a reduction in pressure; this pressure reduction will then provide the needed pressure differential to propel said first fluid through said rotor. Generally, the absolute tangential velocity of the said first fluid after leaving said nozzles, is arranged to be the same as the absolute tangential velocity of the outward ends, or tips, of the vanes located in the rotor cavity on the expansion side of said rotor; these vanes are indicated by numbers 17 and 45, in the figures. As shown in FIG. 1, and FIG. 3, there is a small space without vanes in the rotor near the exit ends of said nozzles; the outer diameter of the said vane tips will then determine the absolute tangential velocity of said vane tips for vanes 17 and 45.

The work input to the rotor wheel is the work required to accelerate said fluids. The first fluid is accelerated on the compression side of said rotor and a predetermined amount of work is required for this acceleration; some of this work is reclaimed when said first fluid is discharged through said nozzles backward, and additional work is reclaimed when said first fluid is decelerated on the expansion side of the said rotor, with said work being transferred back to said rotor wheel. The velocity reduction when said first fluid is discharged backward from said nozzles, normally represents some work loss, and thus said velocity reduction should be kept to minimum. The amount of said velocity reduction will depend on the properties of said first fluid, but generally said velocity reduction is small; for example, if the rotor tangential speed is 1200 feet per second, such velocity reduction may be 40 feet per second, so that the vane tip speed on expansion side of rotor would be 1160 feet per second.

The second fluid heat exchanger on the compression side of the rotor is arranged to remove heat from said first fluid during said compression; this continuous heat removal will result in a higher first fluid pressure at rotor periphery than would be if heat was removed only after compression. Similarly, the heat exchanger in FIG. 3, on the expansion side is arranged to add heat during part of the expansion, and this heat addition will reduce the pressure differential between the rotor center and rotor periphery. Thus, by proper placement of said two heat exchangers, it is possible reduce the pressure differential required at rotor periphery near the rotor nozzles to provide for self propelling of said first fluid, and this reduces the required velocity reduction for said first fluid at rotor nozzles thus reducing work loss. For some fluids, with suitable amount of heat transfer to said second fluid, depending on the temperature of the available third fluid, the first fluid may have sufficient pressure differential to be self-propelled without any velocity reduction at nozzles, and thus said nozzles may be arranged to discharge said first fluid axially or radially; this type operation will then eliminate the work loss that said velocity reduction represents.

The work required to accelerate said second and third fluids is reclaimed nearly completely, since said fluids enter and leave near the center of rotation of said rotor.

When said second fluid is a liquid, said second fluid and said first fluid are arranged to be in what is known as parallel flow in the compression side heat exchanger, with both fluid progressing outward, and said second fluid being then returned from the heat exchanger periphery to rotor center and to exit.

Various regulators and controls are employed with the device of this invention; they do not form a part of this invention and are not further described herein.

Various gaseous fluids may be used as said first fluid, such as air, hydrocarbons, halogenated hydrocarbons and others. For said second fluid, gases or liquids may be used as desired. For said third fluid, also gases or liquids may be used.

The heat exchanger of this invention may be used to heat said second fluid, and thus function as a heat source. Also, said second fluid may be a liquid when entering the unit, and said liquid may be either fully or partially vaporized within said rotor and thus the heat exchanger may be used as a steam generator. Further, the first fluid in the form of the unit shown in FIG. 1, will be a lower temperature when leaving the rotor than at entry, and thus said heat exchanger will also serve as a source of cooling. Also, said third fluid may be used for cooling purposes when the unit is arranged as shown in FIG. 3. Further, this heat exchanger may be employed in place of the component commonly known as a combustor, as used in gas turbines, to add heat to the air after such air has passed through the compression stage in such gas turbine, with said air then being the said second fluid of the heat exchanger of this invention.

If said first fluid and said second fluid are both gaseous, then the two fluids must be so selected that the temperature increase within the said rotor will be greater for said first fluid than for said second fluid. Many such combinations may be arranged, one being said air as said second fluid and Freon 12, as said first fluid.

The rotor components are made of heavy material section as shown to withstand the expected relatively high rotational speeds, with the rotor parts having thicker material near the center. The heat exchangers for the second and third fluid are shown made of finned tubing with said first fluid passing across said tubes through the fins. Normally, said finned tubes are supported by rotor walls to prevent movement and crushing of said fins and tubes by centrifugal force. Said second fluid and third fluid heat exchangers may be also made by using some other technique, such as providing passages for said fluids in said rotor walls with fins provided within the rotor cavity to improve heat transfer.

The divider within said rotor shown in the figures mounted at the rotor periphery with its nozzles, may be located elsewhere between the rotor periphery and the rotor center on the expansion side of the rotor. In these arrangements, the vanes, such as vanes 17 in FIG. 1, will then extend to the periphery at their outer ends, but there will be no vanes immediately downstream of the said divider and its nozzles, with space left to allow equalization of the absolute velocities of the fluid and said vanes.

What is claimed is:

1. In a rotary heat exchanger having a rotor having two longitudinally spaced radially extending passages in one of which a first fluid is compressed and heated by the rotation of the rotor and means in heat exchange relationship with the compressed first fluid to remove heat therefrom, the improvement, in combination therewith, of a plurality of nozzles connecting the two radially extending passages through which the first fluid can flow from the passage in which it is compressed to the other passage for expansion, said nozzles being positioned to discharge said first fluid into said other passage in a direction generally opposite the direction of rotation of said rotor to reduce the tangential velocity of the fluid.

2. A heat exchanger comprising a rotor, means for mounting the rotor for rotation, said rotor having first and second radially extending passages, passage means comprising a set of nozzles for connecting the outer ends of said first and second passages to allow a fluid to flow from said first passage into said second passage, said nozzles being positioned to discharge said fluid flowing therethrough into the second passage in a direction away from the direction of rotation of the rotor to reduce the tangential velocity of the fluid, and means in heat exchange relationship with the fluid for removing heat from said fluid.

3. The heat exchanger of claim 2 in which the velocity of the fluid discharged from the nozzles is substantially equal to the velocity of the rotor at the nozzles.

* * * * *